US006575819B2

(12) United States Patent
Beyersdorff

(10) Patent No.: US 6,575,819 B2
(45) Date of Patent: Jun. 10, 2003

(54) FLOOR ACCESSORY DRIVER

(76) Inventor: Kurt Beyersdorff, 5326 Spencer St., Torrance, CA (US) 90503

( * ) Notice: Subject to any disclaimer, the term of this patent is extended or adjusted under 35 U.S.C. 154(b) by 0 days.

(21) Appl. No.: 09/772,085

(22) Filed: Jan. 26, 2001

(65) Prior Publication Data

US 2002/0009961 A1 Jan. 24, 2002

Related U.S. Application Data

(60) Provisional application No. 60/178,280, filed on Jan. 27, 2000.

(51) Int. Cl.[7] ..... B24B 23/03

(52) U.S. Cl. ..... 451/352; 451/178; 180/4; 299/39; 125/13.01

(58) Field of Search ..... 451/352, 178; 125/13.01; 180/11; 299/39

(56) References Cited

U.S. PATENT DOCUMENTS 3,161,994 A * 12/1964 Neitzer et al. ..... 451/352
3,867,796 A * 2/1975 Sonnenberg ..... 451/352
3,929,377 A * 12/1975 Weaver et al. ..... 299/39
5,092,658 A * 3/1992 Smith ..... 299/39
5,263,769 A * 11/1993 Pharr et al. ..... 299/39
RE34,822 E * 1/1995 Mattson ..... 180/11
5,724,956 A * 3/1998 Ketterhagen ..... 125/13.01

* cited by examiner

*Primary Examiner*—George Nguyen
(74) *Attorney, Agent, or Firm*—Roger A. Marrs

(57) ABSTRACT

A floor accessory driver for floor sanding procedures includes a driven unit having a sanding drum carried on a wheeled chassis that is detachably connected to a driver unit which includes a seat for an operator and further includes a DC driving unit for electrically powering a set of wheels. Operation of the electrical system is under the foot control via a pivoting treadle for controlling forward and reverse direction of the driver unit and for simultaneously controlling the speed of the driving unit. A preset maximum speed control is connected to the electrical circuit and an eccentric cam positions a follower to operate a micro-switch that controls speed. Direction of travel, either forward or in reverse, is under control of the foot pedal via potentiometers which are connected at opposite ends of the treadle so as to operate alternately as the treadle is pivoted.

2 Claims, 2 Drawing Sheets

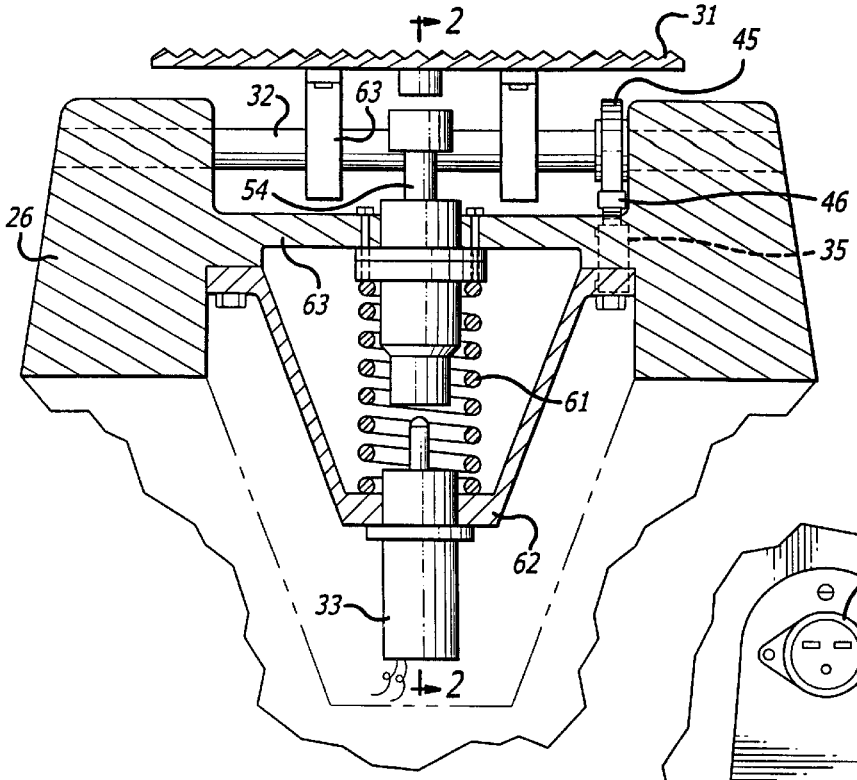
FIG. 3
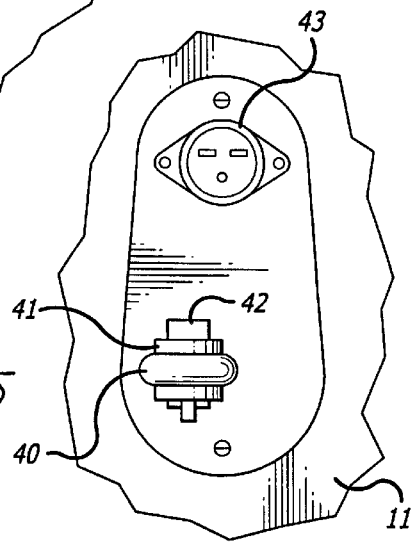
FIG. 5
FIG. 4
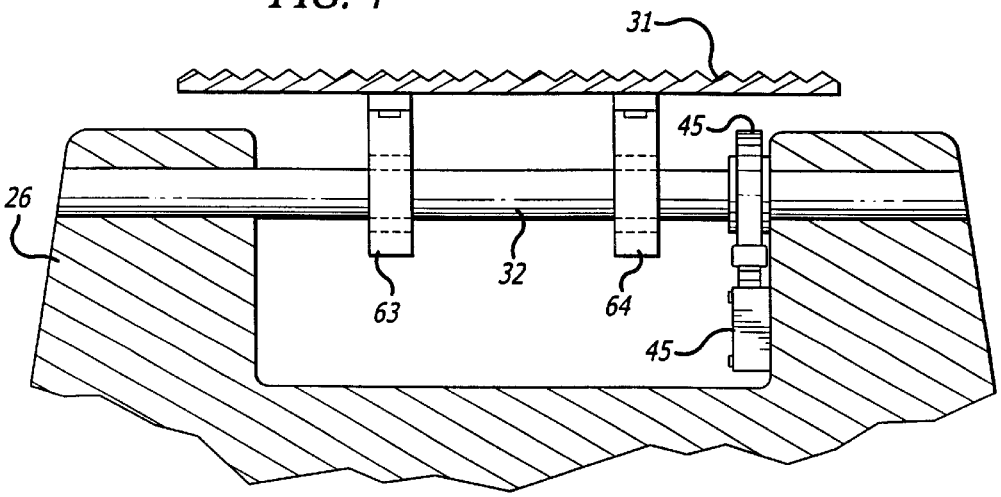

FLOOR ACCESSORY DRIVER

This application claims the benefit of Ser. No. 60/178,280 filed Jan. 27, 2000.

BACKGROUND OF THE INVENTION

1. Field of the Invention

The present invention relates to the field of power drivers, and more particularly to a novel seated driver having direct current motor drive through a pair of wheels which is detachably connected to a mobile carriage mounting a floor finishing device such as a sanding drum wherein the seated driver includes speed and directional controls.

2. Brief Description of the Prior Art

In the past, it has been the conventional practice to prepare and/or finish a wooden floor surface by employing an apparatus having a sanding drum which is maneuvered over the wood surface in order to prepare or finish the surface. Conventional apparatus generally includes a mobile carriage having a sanding drum which is maneuvered over a floor surface by means of a hydraulic powered driver unit. The driver unit is usually coupled to the mobile carriage and a seat is provided on the driver unit for accommodating the operator who steers the apparatus via a steering mechanism carried on the mobile carriage.

Although successful for finishing or refinishing a wooden floor surface, conventional apparatus has experienced difficulties and problems which stem largely from the fact that the driver unit incorporates hydraulic mechanisms which are extremely heavy in weight and require periodic maintenance. Also, such prior apparatus is difficult to control with respect to speed and direction since all controls must be coupled into the hydraulic system in order to operate. Hydraulic driver units are generally dirty since such units require oil reservoirs or high pressure hydraulic fluid lines which have a tendency to leak. Some attempts have been made to avoid the situation by using alternating current driving units but the use of alternating current requires excessive wattage and high draw or drain of electricity.

Therefore, a long-standing need has existed to provide a novel floor accessory apparatus which includes an improved driving unit that is light in weight, includes direct current power drive and incorporates speed and direction controls which are operated from DC power. The units should also include improved electrical and mechanical connection between the driving unit and the mobile carriage or driven unit so that special knowledge or extensive installation or hookup mechanisms are not required.

SUMMARY OF THE INVENTION

Accordingly, the above problems and difficulties have been avoided by the present invention which provides a novel floor accessory driver, particularly for use in connection with floor sanding procedures, which includes a driven unit having a sanding drum carried on a wheeled chassis which in turn is detachably connected to a driver unit that includes a seat on which the operator sits and further includes a DC driving means for electrically powering a set of wheels. Operation of the electrical system is under the foot control of the operator via a pivoting treadle for controlling forward and reverse direction of the driver unit and for simultaneously controlling the speed of the driving unit. A maximum speed control is also connected to the electrical circuit which may be preset by the operator. In one form of the invention, foot treadle includes an eccentric cam which positions a cam follower to operate a microswitch that controls speed. Direction of travel, either forward or in reverse, is under control of the foot pedal via potentiometers which are connected at opposite ends of the treadle so as to operate alternately as the treadle is pivoted.

The invention further includes a tongue-in-groove arrangement for detachably connecting the driver unit to the mobile driven unit which may include a yoke into which a loop is inserted and wherein the yoke and loop are maintained in contact by a keeper bolt or pin. The hitch or coupling permits limited pivotal movement which is useful in permitting the operator to steer the mobile unit via a hand-steering means carried on the end of a column projecting from the top of the mobile unit. The mobile unit further includes an AC current control for a sanding wheel and an electrical power cable is detachably connected to the steering column which, in turn, is connected to the AC motor.

The driver unit includes a chassis which supports the DC drive motor and since an electrical drive system is provided, the structure and weight of the driver unit is greatly reduced as compared to hydraulic operated systems.

Therefore, it is among the primary objects of the present invention to provide a novel combined driver unit and driven unit which are coupled together by a pivotal hitch and wherein the driver unit includes a DC drive so that the weight and complexity of the driver unit is greatly reduced as compared with hydraulic systems and structures.

Another object of the present invention is to provide a driver unit which includes a reversible foot switch mechanism that is pivoted so as to alternately operate potentiometers in order to determine reverse or forward direction as well as to control speed.

Another object of the present invention is to provide a fully electronic floor sanding driver which is less than half the size of other floor sanding drivers and which is significantly lighter than other floor sanding drivers.

Still a further object resides in providing a floor sanding driver and driven unit that can be used in confined areas such as residential applications as well as in large commercial areas such as gymnasiums or the like.

The present invention further resides in the provision of two types of speed control which is operated by a foot pedal and a maximum speed potentiometer.

Another object resides in providing adjustments to a DC electrical system for rate of acceleration and deceleration with respect to control of a driver unit.

Further objects include compensation for load such as maintaining constant and/or even speed as well as providing independent control for roward/reverse speeds.

A further object of the invention resides in providing an electrical system for driving a driver unit which draws only 25% of electricity that other floor sanding drivers require.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood with reference to the following description, taken in connection with the accompanying drawings in which:

FIG. 3 is an enlarged sectional view taken in the direction of arrows 3—3 of FIG. 2 illustrating the mounting of potentiometers in connection with operation by the foot treadle;

FIG. 4 is a transverse cross-sectional view of the foot treadle shown in FIG. 2 as taken in the direction of arrows 4—4 thereof; and FIG. 5 is an elevational view of the mobile driven unit showing an electrical plug connector and the hitch arranged in an offset relationship.

DESCRIPTION OF THE PREFERRED EMBODIMENT

Figure 1:
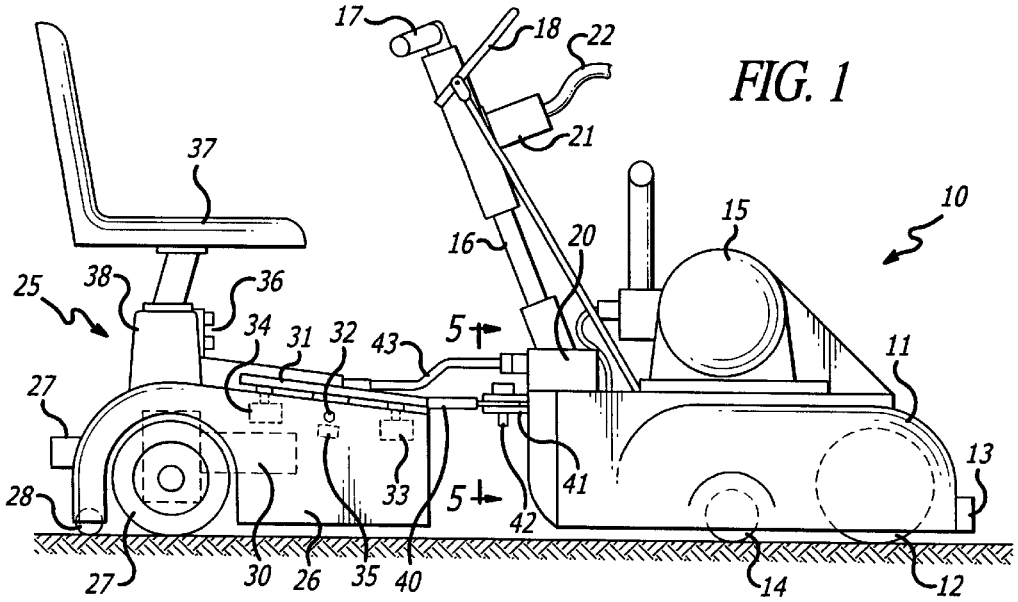
FIG. 1 is a side elevational view of the novel floor accessory apparatus of the present invention illustrating a driven unit and a driving unit connected by a detachable hitch.

Referring to FIG. 1, the novel floor accessory apparatus of the present invention is illustrated in the general direction of arrow 10 which includes a driven unit 11 providing a mobile carriage on which a sanding drum 12 is rotatably carried. The chassis for the driven unit further includes a front end having a bumper 13 and a drive wheel or wheels 14 operable by an AC motor 15. The mobile driven unit 11 further includes a steering column 16 which upwardly projects from the top surface of the chassis to terminate in handgrips 17 intended to be used by the operator for steering the apparatus. The control lever 18 is employed for operating the drive motor for the sanding drum. Power for the motor 15 is provided via an electrical box 20 through which power from connector 21 and cable 22 conduct power from a remote location.

The subject of the present invention is a driver unit indicated in the general direction of arrow 25 which includes a chassis 26 on which a pair of drive wheels 27 are operably connected. The chassis 26 further includes a rear bumper 27 as well as small wheels 28 which may be used when the driver unit is disconnected from the driven unit and it is desired to transport or move the driver unit about without use of power. The wheels 28 serve as tilting wheels in order to store the driver unit when not in use.

The driver unit further includes a DC motor 30 which is operably connected to the wheels 27 so as to drive the driver unit in either a forward or reverse direction and at a controlled speed. The control foot treadle or pedal 31 is pivotally attached to the chassis 26. As the front end of the treadle is depressed, a forward potentiometer 33 is placed in operation while alternately pivoting the foot treadle rearwardly causes operation of a reverse potentiometer 34. A cam operated microswitch 35 works in unison with the potentiometers 33 and 34 to control speed and additionally, a speed control knob 36 is provided for adjusting maximum speed.

A seat 37 is provided on a pedestal 38 so that the operator may comfortably operate the apparatus in a sitting position with one foot on the treadle 31 while the opposite foot rests on the opposite side of the chassis. The operator can easily reach the handle grips 17 for steering the driven unit 11 in a particular direction. However, it is to be understood that directional control either forward or reverse is under the foot pedal control and the respective potentiometers 33 and 34 in operable connection with the DC motor 30.

It is to be particularly noted that the drive unit 25 is detachably coupled to the driven unit 11 by means of a hitch which in one form is a tang inserted into a yoke 41 and retained together by means of a keeper or bolt 42. Preferably, the coupling is pivotal so that as the operator steers the driven unit 11, the driver unit will be in a position to exert directional control. Also, it can be seen that power for the DC motor 30 as well as the control circuitry is connected to the power box 20 via a detachable plug and cable arrangement 43.

Figure 2:
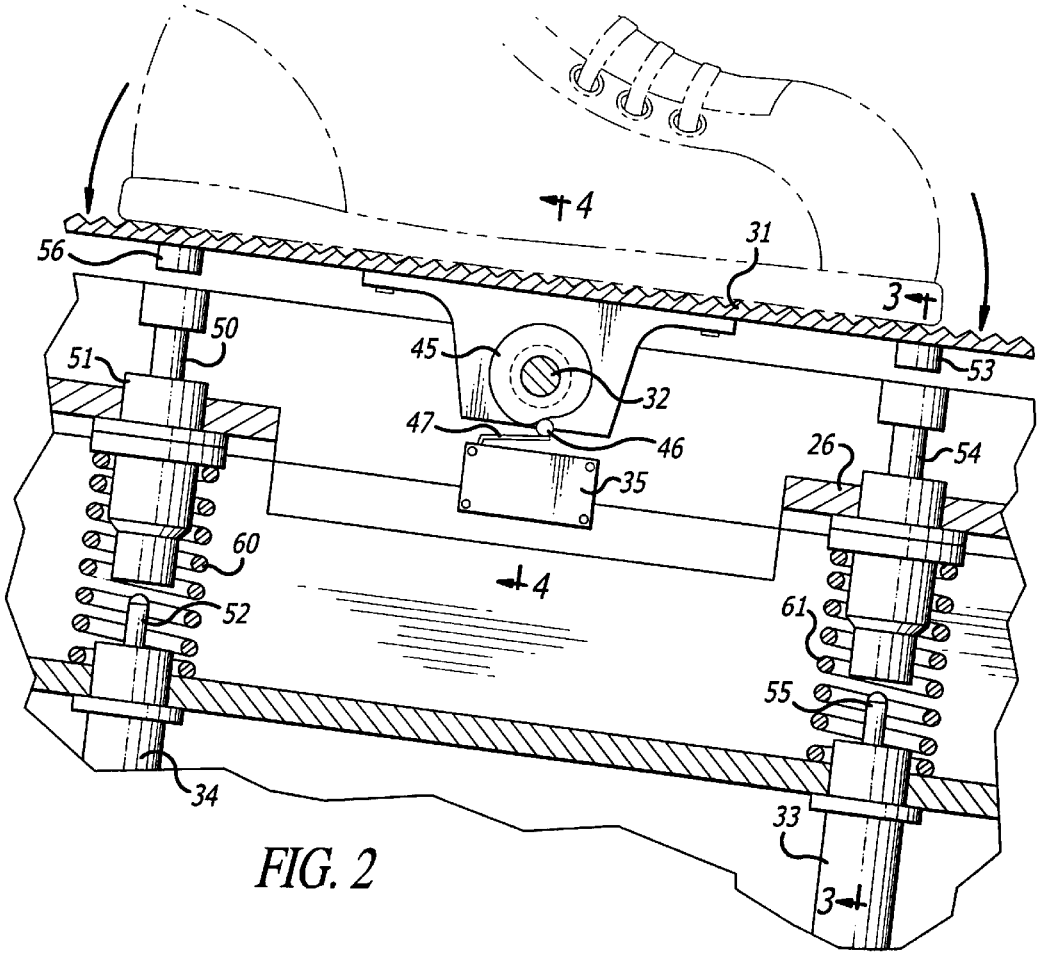
FIG. 2 is a greatly enlarged sectional view illustrating the foot treadle control for speed control as well as forward and reverse control.

Referring now in detail to FIG. 2, it can be seen that the pivoting treadle 31 further includes a cam 45 which is of an eccentric type and that as the cam rotates with the treadle 31, a cam follower 36 is caused to operate an arm 47 of the microswitch 35. Likewise, as the treadle rotates forward, the spring biased shoulder bolt plunger 50 proceeds through a bearing 51 causing the end of the fitting to strike a plunger 52 actuating the potentiometer 34. The device will then move in a rearward or reverse direction. However, when the pedal is rotated forwardly, the stud 53 engages with the shoulder bolt plunger 54 so that the plunger will strike the potentiometer plunger 55 for operating the forward potentiometer 33. In broken lines, it can be seen that the heel of the operator's shoe when depressed will cause the stud 56 to strike the plunger 50 while depression of the toe of the operator's shoe or boot will cause depression of the shoulder bolt plunger 54 and actuation of the forward potentiometer 33.

In FIGS. 2 and 3, it can be seen that the shoulder bolt plungers are normally balanced away from the respective potentiometers by means of helical spring 60 associated with potentiometer 34 and spring 61 associated with potentiometer 33. FIG. 3 further illustrates that the potentiometers are mounted on a casting 62 which downwardly depends from a cross member 63 integrally formed with the chassis 26. Also, the treadle or pedal 31 is carried on a yoke which includes members 63 and 64 which in turn are coupled to the pivot shaft 32. The opposite ends of the shaft are connected to the chassis 26. Also, it can further be seen that the cam 35 is carried on the pivot shaft 32 and will rotate therewith in order to operate the cam follower 36 and microswitch arm 37.

Referring now in detail to FIG. 4, it can again be seen that the cam 45 is operable to actuate the microswitch 45 upon rotation of the pivot shaft 32 in response to fore or aft movement of the foot treadle 31.

In FIG. 5, it is preferred that the switch or detachable coupling means between the driven unit and the driver unit be offset from the electrical socket 43 carried on the chassis 11 of the driven unit.

In view of the foregoing, it can be seen that the mobile carriage or driven unit 11 is a working unit which includes a sanding drum and wheels for moving the unit about. The mobile or driven unit 11 is pushed or pulled by the driver unit 25 which includes directional and speed controls all under operation of the operator who is also steering the apparatus by means of the steering handle. The units are coupled together by a detachable means and power for the DC motor is derived from a switchbox and cabling interconnecting the driven unit with the driver unit. The foot pedal control provides a foot control for operating the various potentiometers and switches in the electrical system. It is the use of a DC motor which permits lighter construction and does not require heavy tubing, oil reserves, tanks or the like.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A power driver unit for use in floor sanding procedures comprising:

a wheeled frame having an operator seat mounted thereon and a steering means movably supported thereon for determining direction of travel;

a foot control means disposed adjacent to said operator seat on said frame for selecting forward and reverse direction of travel of the power driven unit;

said foot control means includes a foot treadle pivotally carried on said frame operable between a first position and a second position;

DC electrical power means responsive to actuation of said foot treadle to move said frame in a selected direction of travel;

a micro switch included in said foot control means responsive to pivotal movement of said foot treadle to energize said electrical power means;

a pair of spaced-apart potentiometers alternatively operable to control direction of said frame in either a forward or backward direction;

spring means interposed between opposite ends of said foot treadle and said frame normally biasing said foot treadle out of engagement with said potentiometers;

said foot control means further includes an eccentric cam and cam follower arrangement for selectively operating said micro switch in response to rotation of said foot treadle;

said power means includes a DC motor selectively coupled with said foot control means to provide a light weight electrical drive for said frame.

2. A power driver unit and a driven unit combination for use in floor sanding procedures comprising:

a mobile driven unit having a sander means;

a mobile driving unit having a power means for propelling said driving unit;

detachable coupling means inter-connecting said driver unit with said driven unit;

said driver unit adapted to selectively push and pull said driven unit in a forward or backward direction;

mechanical means supported on said driver unit responsive to manual actuation;

DC electrical means on said driver unit responsive to said mechanical means for controlling speed and selection of forward or backward directional movement;

said electrical means includes a DC motor selectively operating a first pair of wheels rollably supporting said driver unit;

said driven unit includes a second pair of wheels rollably supporting said driven unit;

said first and said second pairs of wheels solely supporting said driver unit and said driven unit as a unitary floor sanding equipment;

a sanding means rotatably carried on said driven unit and detachable cable means interconnecting said DC motor with said sanding means in parallel relationship with said first set of wheels for independent operation thereof; and said detachable coupling means includes a tongue-in-groove coupling arrangement releasably connected together by a fastener.

* * * * *